US007897541B2

(12) United States Patent
Iwasaki et al.

(10) Patent No.: US 7,897,541 B2
(45) Date of Patent: Mar. 1, 2011

(54) THERMOSENSITIVE RECORDING MEDIUM

(75) Inventors: Nobuyuki Iwasaki, Amagasaki (JP); Hisashi Tani, Amagasaki (JP); Masato Kawai, Amagasaki (JP); Masaharu Nojima, Amagasaki (JP)

(73) Assignee: OJI Paper Co., Ltd., Tokyo (JP)

( * ) Notice: Subject to any disclaimer, the term of this patent is extended or adjusted under 35 U.S.C. 154(b) by 942 days.

(21) Appl. No.: 11/792,061

(22) PCT Filed: Dec. 13, 2005

(86) PCT No.: PCT/JP2005/022815

§ 371 (c)(1),
(2), (4) Date: Jun. 1, 2007

(87) PCT Pub. No.: WO2006/064778

PCT Pub. Date: Jun. 22, 2006

(65) Prior Publication Data

US 2008/0108500 A1 May 8, 2008

(30) Foreign Application Priority Data

Dec. 13, 2004 (JP) ..... 2004-359300
Mar. 2, 2005 (JP) ..... 2005-057208
Sep. 8, 2005 (JP) ..... 2005-260004

(51) Int. Cl.
*B41M 5/333* (2006.01)

(52) U.S. Cl. ..... 503/216

(58) Field of Classification Search ..... None
See application file for complete search history.

(56) References Cited

U.S. PATENT DOCUMENTS 3,539,375 A 11/1970 Baum ..... 117/36.2
5,256,618 A 10/1993 Takahashi et al. ..... 503/216
6,232,266 B1 5/2001 Masuda et al. ..... 503/200

FOREIGN PATENT DOCUMENTS

EP 0 774 363 A1 5/1997
JP 45-14039 B 5/1970
JP 60-244594 A 12/1985
JP 61-86283 A 5/1986
JP 5-147357 A 6/1993
JP 9-76641 A 3/1997
JP 9-263057 A 10/1997
JP 9-309270 A 12/1997
JP 2000-158822 A 6/2000
JP 2001-113841 A 4/2001
JP 2001-310561 * 11/2001
JP 2003-054137 * 2/2003
JP 2003-54137 A 2/2003
JP 2003-118234 A 4/2003
JP 2003-266951 A 9/2003

* cited by examiner

*Primary Examiner*—Bruce H Hess
(74) *Attorney, Agent, or Firm*—Kubovcik & Kubovcik

(57) ABSTRACT

The present invention provides a heat-sensitive recording material comprising a support and a heat-sensitive recording layer, wherein the heat-sensitive recording layer contains a leuco dye and a color developer, the leuco dye is in a form of composite particles comprising the leuco dye and a hydrophobic resin, and the color developer comprises at least 4,4'-cyclohexylidenediphenol and 4,4'-bis(N-p-tolylsulfonylaminocarbonylamino)diphenylmethane.

12 Claims, 1 Drawing Sheet

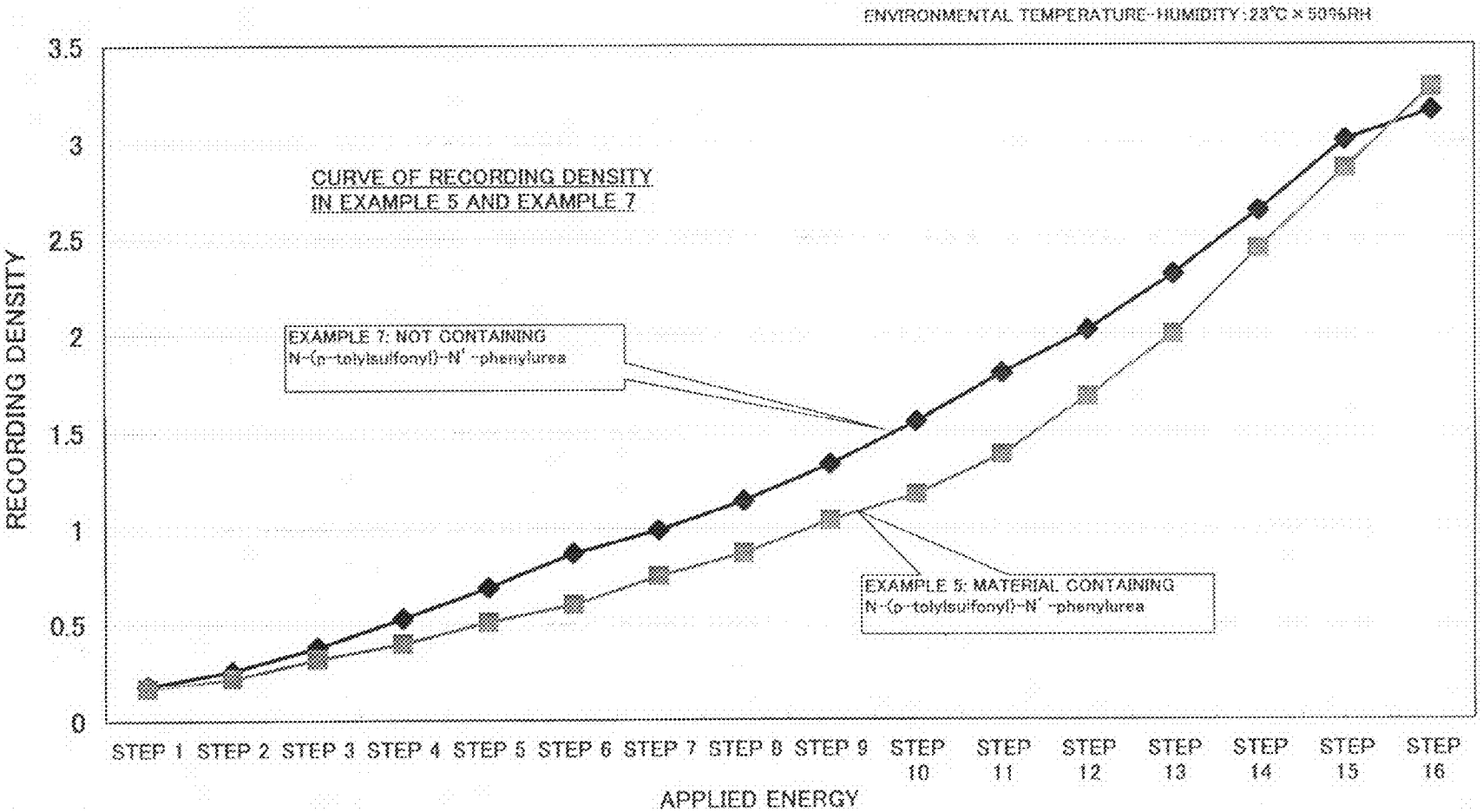
ENVIRONMENTAL TEMPERATURE-HUMIDITY: 22°C × 50%RH
CURVE OF RECORDING DENSITY
IN EXAMPLE 5 AND EXAMPLE 7
EXAMPLE 7: NOT CONTAINING
N-(p-tolylsulfonyl)-N'-phenylurea
EXAMPLE 5: MATERIAL CONTAINING
N-(p-tolylsulfonyl)-N'-phenylurea
RECORDING DENSITY
3.5
3
2.5
2
1.5
1
0.5
0
STEP 1 STEP 2 STEP 3 STEP 4 STEP 5 STEP 6 STEP 7 STEP 8 STEP 9 STEP 10 STEP 11 STEP 12 STEP 13 STEP 14 STEP 15 STEP 16
APPLIED ENERGY

THERMOSENSITIVE RECORDING MEDIUM

TECHNICAL FIELD

The present invention relates to a heat-sensitive recording material that uses a color forming reaction between a leuco dye and a color developer. In particular, the present invention relates to a heat-sensitive recording material for which there is little fluctuation in recording sensitivity due to change in the humidity of the environment in which the heat-sensitive recording material is used (hereinafter sometimes referred to as "change in environmental humidity".

BACKGROUND ART

From hitherto, heat-sensitive recording materials that use a color forming reaction through heat between a leuco dye and a color developer have been well known. Such a heat-sensitive recording material is relatively inexpensive, and moreover the recording apparatus is compact and relatively easy to maintain. Heat-sensitive recording materials have thus come to be used not only as recording media for facsimiles, various calculating machines and so on, but also as recording media used in printers of equipment for medical diagnosis such as MRI diagnostic imaging and X-ray diagnostic imaging, and recording media for CAD plotters and the like.

However, with such a heat-sensitive recording material that uses a leuco dye and a color developer, there is a drawback that, upon the amount of moisture in the heat-sensitive recording layer changing accompanying a change in the humidity of the environment in which the recording material is used, the recording sensitivity fluctuates, and as a result the recording density fluctuates, and in particular it is difficult to obtain constant recording density in a halftone region. This drawback is particularly marked in the case of using a support such as a synthetic resin film.

For a heat-sensitive recording material, it is desirable for the recording sensitivity to always be constant, not fluctuating due to differences in the humidity of the usage environment with season, region, country or the like. In particular, for a heat-sensitive recording material used for medical diagnosis, there are strong demands for images on a par with those using a silver salt system to be obtained, for recording to be possible with multiple gradient steps, and for the recording density in the halftone region to be constant, not being affected by changes in the humidity of the environment. There are thus strong demands for a heat-sensitive recording material for which the above drawback is improved upon.

4,4'-cyclohexylidenediphenol has been known from long ago as a color developer used in heat-sensitive recording materials (see patent document 1). Moreover, there has also been proposed a method in which this color developer is used, so as to obtain a heat-sensitive recording material having little background fogging, and having a large difference in transmission density between recorded portions and non-recorded portions (see patent document 2).

Moreover, 4,4'-bis(N-p-tolylsulfonylaminocarbonylamino)diphenylmethane is also known as a color developer, and there has also been proposed a method in which this color developer is used so as to obtain a heat-sensitive recording material for which the oil resistance and plasticizer resistance of recorded images are improved, and hence the long-term stability of recorded images is improved (see patent document 3).

Moreover, to improve the storability for recorded portions of a heat-sensitive recording material, there have been proposed, for example, a method in which there are used composite particles obtained by making a leuco dye and a hydrophobic organic solvent into microcapsules using a wall material made of a hydrophobic resin (see patent documents 4 and 5), a method in which there are used composite particles obtained by polymerizing an acrylic hydrophobic resin on the surface of a leuco dye (see patent document 6), and a method in which there are used composite particles obtained by making a leuco dye be contained in a hydrophobic resin (see patent documents 7 and 8).

Patent document 1: Japanese Examined Patent Publication No. 45-14039 (page 4)

Patent document 2: Japanese Unexamined Patent Publication No. 9-76641 (claim 1)

Patent document 3: Japanese Unexamined Patent Publication No. 5-147357 (example 1)

Patent document 4: Japanese Unexamined Patent Publication No. 60-244594 (claim 1)

Patent document 5: Japanese Unexamined Patent Publication No. 61-86283 (example 1)

Patent document 6: Japanese Unexamined Patent Publication No. 2000-158822 (claims 1 and 7)

Patent document 7: Japanese Unexamined Patent Publication No. 9-263057 (claim 1)

Patent document 8: Japanese Unexamined Patent Publication No. 2003-266951 (claim 1).

DISCLOSURE OF THE INVENTION

Problems to be Solved by the Invention

It is an object of the present invention to provide a heat-sensitive recording material for which there is little fluctuation in recording sensitivity due to change in environmental humidity for the heat-sensitive recording material, and moreover image quality and thermal background fogging resistance are excellent.

Means for Solving the Problems

The present invention provides a heat-sensitive recording material comprising a support and a heat-sensitive recording layer, wherein the heat-sensitive recording layer contains a leuco dye and a color developer, the leuco dye is in a form of composite particles comprising the leuco dye and a hydrophobic resin, and the color developer comprises at least 4,4'-cyclohexylidenediphenol and 4,4'-bis(N-p-tolylsulfonylaminocarbonylamino)diphenylmethane.

That is, the present invention includes heat-sensitive recording materials as follows.

Item 1: A heat-sensitive recording material comprising a support and a heat-sensitive recording layer, wherein the heat-sensitive recording layer contains a leuco dye and a color developer, the leuco dye is in a form of composite particles comprising the leuco dye and a hydrophobic resin, and the color developer comprises 4,4'-cyclohexylidenediphenol and 4,4'-bis(N-p-tolylsulfonylaminocarbonylamino)diphenylmethane.

Item 2: A heat-sensitive recording material according to item 1, wherein the color developer is obtained through wet pulverizing of a composition comprising 4,4'-cyclohexylidenediphenol and 4,4'-bis(N-p-tolylsulfonylaminocarbonylamino)diphenylmethane.

Item 3: A heat-sensitive recording material according to item 1 or 2, wherein the content of 4,4'-bis(N-p-tolylsulfonylaminocarbonylamino)diphenylmethane is in a range of 15 to 75 mass % relative to 4,4'-cyclohexylidenediphenol.

Item 4: A heat-sensitive recording material according to any of items 1 to 3, wherein the color developer further contains 4-hydroxy-4'-allyloxydiphenylsulfone.

Item 5: A heat-sensitive recording material according to item 4, wherein the color developer is obtained through wet pulverizing of a composition comprising 4,4'-cyclohexylidenediphenol, 4,4'-bis(N-p-tolylsulfonylaminocarbonylamino)diphenylmethane, and 4-hydroxy-4'-allyloxydiphenylsulfone.

Item 6: A heat-sensitive recording material according to item 4 or 5, wherein the content of 4-hydroxy-4'-allyloxydiphenylsulfone is in a range of 10 to 50 mass % relative to 4,4'-cyclohexylidenediphenol.

Item 7: A heat-sensitive recording material according to any of items 1 to 6, wherein the color developer further contains N-(p-tolylsulfonyl)-N'-phenylurea.

Item 8: A heat-sensitive recording material according to item 7, wherein the content of N-(p-tolylsulfonyl)-N'-phenylurea is in a range of 25 to 150 mass % relative to 4,4'-cyclohexylidenediphenol.

Item 9: A heat-sensitive recording material according to any of items 1 to 8, wherein the hydrophobic resin in the composite particles is a urea-based resin or a urea-urethane-based resin.

Item 10: A heat-sensitive recording material according to any of items 1 to 9, wherein the support is a transparent film.

Item 11: A heat-sensitive recording material according to any of items 1 to 10, further comprising a protective layer.

Item 12: A heat-sensitive recording material according to any of items 1 to 11, wherein the color developer contains 4,4'-cyclohexylidenediphenol, 4,4'-bis(N-p-tolylsulfonylaminocarbonylamino)diphenylmethane, 4-hydroxy-4'-allyloxydiphenylsulfone and N-(p-tolylsulfonyl)-N'-phenylurea.

Following is a detailed description of the present invention.

I. Heat-Sensitive Recording Layer

The heat-sensitive recording material of the present invention contains a color developer and a leuco dye in the heat-sensitive recording layer.

I-1. Color Developer

The color developer in the present invention comprises at least 4,4'-cyclohexylidenediphenol and 4,4'-bis(N-p-tolylsulfonylaminocarbonylamino)diphenylmethane.

By using 4,4'-cyclohexylidenediphenol and 4,4'-bis(N-p-tolylsulfonylaminocarbonylamino)diphenylmethane together, fluctuations in recording sensitivity due to change in the humidity of the environment are suppressed, and image quality becomes excellent.

In the case of not using 4,4'-cyclohexylidenediphenol, the recording sensitivity, in particular the recording sensitivity in a halftone region, becomes prone to fluctuating due to change in the humidity of the environment in which the heat-sensitive recording material is used.

On the other hand, in the case of not using 4,4'-bis(N-p-tolylsulfonylaminocarbonylamino)diphenylmethane, the 4,4'-cyclohexylidenediphenol crystallizes in a heat-sensitive recording layer coating liquid, and hence the image quality of the heat-sensitive recording material obtained decreases.

The color developer used can be obtained by dispersing the above. For example, the color developer can be obtained by adding a dispersion of 4,4'-bis(N-p-tolylsulfonylaminocarbonylamino)diphenylmethane alone to 4,4'-cyclohexylidenediphenol.

However, a color developer obtained by mixing together and dispersing (co-dispersing) 4,4'-cyclohexylidenediphenol and 4,4'-bis(N-p-tolylsulfonylaminocarbonylamino)diphenylmethane, in other words a color developer obtained by preparing a composition comprising 4,4'-cyclohexylidenediphenol and 4,4'-bis(N-p-tolylsulfonylaminocarbonylamino)diphenylmethane and subjecting the composition to wet pulverizing, is more preferable since the image quality of the heat-sensitive recording material obtained is better.

There are no particular limitations on the particle diameter of the color developer dispersion, but the volume average particle diameter is preferably in a range of 0.1 to 1.0 μm, more preferably 0.2 to 0.5 μm.

The proportion of 4,4'-bis(N-p-tolylsulfonylaminocarbonylamino)diphenylmethane used is preferably in a range of 15 to 75 mass %, more preferably 20 to 65 mass %, relative to the 4,4'-cyclohexylidenediphenol. By making this proportion be in such a range, crystallization of the 4,4'-cyclohexylidenediphenol in the heat-sensitive recording layer coating liquid is suppressed, and hence the image quality for the heat-sensitive recording material is further improved.

In the present invention, the color developer may further contain other compounds in addition to 4,4'-cyclohexylidenediphenol and 4,4'-bis(N-p-tolylsulfonylaminocarbonylamino)diphenylmethane in accordance with the objective so long as this is within a range such as not to impair the desired effects of the present invention.

Such other compounds include, for example, phenol compounds such as 4,4'-isopropylidenediphenol, 2,2-bis(4-hydroxyphenyl)-4-methylpentane, benzyl 4-hydroxybenzoate, 4,4'-dihydroxydiphenylsulfone, 2,4'-dihydroxydiphenylsulfone, 4-hydroxy-4'-isopropoxydiphenylsulfone, 4-hydroxy-4'-allyloxydiphenylsulfone, bis(3-allyl-4-hydroxyphenyl)sulfone, 4,4'-bis[(4-methyl-3-phenoxycarbonylaminophenyl)ureido]diphenylsulfone, 4-hydroxy-4'-methyldiphenylsulfone, 3,4-dihydroxyphenyl-4'-methylphenylsulfone, bis(4-hydroxyphenylthioethoxy)methane and butyl bis(p-hydroxyphenyl)acetate, compounds having an —$SO_2$NHCO— linkage in the molecule thereof such as p-cumylphenyl N-(p-toluenesulfonyl)carbamate, N-(p-tolylsulfonyl)-N'-phenylurea and N-(o-tolyl)-p-tolylsulfonamide, and zinc salts of aromatic carboxylic acids such as zinc p-chlorobenzoate, zinc 4-[2-(p-methoxyphenoxy)ethyloxy]salicylate, zinc 4-[3-(p-tolylsulfonyl)propyloxy]salicylate and zinc 5-[p-(2-p-methoxyphenoxyethoxy)cumyl]salicylate. One of these may be used, or a plurality may be used.

Of these, 4-hydroxy-4'-allyloxydiphenylsulfone is preferable.

It is preferable for 4-hydroxy-4'-allyloxydiphenylsulfone to be used in combination with the 4,4'-cyclohexylidenediphenol and 4,4'-bis(N-p-tolylsulfonylaminocarbonylamino)diphenylmethane, since then a phenomenon in which, in the case of storing the heat-sensitive recording material in a high-humidity environment after recording, the 4,4'-cyclohexylidenediphenol which is a color forming component in the recorded portions crystallizes and thus precipitates out on the heat-sensitive recording material, i.e. a so-called blooming phenomenon is prevented. Note that, here, the blooming phenomenon is a phenomenon in which at the recorded portions, the 4,4'-cyclohexylidenediphenol which is a component of the color developer crystallizes on the surface at the recorded portions, and hence is seen as a white powder scattered over the surface at the recorded portions.

In the case of also using 4-hydroxy-4'-allyloxydiphenylsulfone, the proportion used is preferably approximately in a range of 10 to 50 mass %, more preferably 20 to 40 mass %, relative to the 4,4'-cyclohexylidenediphenol.

In the case of also using 4-hydroxy-4'-allyloxydiphenylsulfone, the color developer can be obtained, for example, by adding a dispersion of 4-hydroxy-4'-allyloxydiphenylsulfone alone to a dispersion that has been obtained by mixing together and dispersing (co-dispersing) 4,4'-cyclohexylidenediphenol and 4,4'-bis(N-p-tolylsulfonylaminocarbonylamino)diphenylmethane.

However, a color developer obtained by mixing together and dispersing (co-dispersing) 4,4'-cyclohexylidenediphenol, 4,4'-bis(N-p-tolylsulfonylaminocarbonylamino)diphenylmethane and 4-hydroxy-4'-allyloxydiphenylsulfone, in other words a color developer obtained by preparing a composition comprising 4,4'-cyclohexylidenediphenol, 4,4'-bis(N-p-tolylsulfonylaminocarbonylamino)diphenylmethane and 4-hydroxy-4'-allyloxydiphenylsulfone and subjecting the composition to wet pulverizing, is preferable due to the operation being simpler.

There are no particular limitations on the particle diameter of the color developer dispersion, but the volume average particle diameter is preferably in a range of 0.1 to 1.0 μm, more preferably 0.2 to 0.5 μm.

Moreover, the color developer preferably further contains N-(p-tolylsulfonyl)-N'-phenylurea.

It is preferable for N-(p-tolylsulfonyl)-N'-phenylurea to be used in combination with the 4,4'-cyclohexylidenediphenol and 4,4'-bis(N-p-tolylsulfonylaminocarbonylamino)diphenylmethane, since then fine image gradation can be obtained in a halftone region in particular. Here, fine image gradation means that there is little change in recording density with applied energy. The "halftone region" is, in other words, the medium recording density region, and refers, for example, to the region of recording density 1.0 to 1.5 as measured by a Macbeth densitometer (trade name: TR-927J, made by Macbeth Corp.).

In the case of also using N-(p-tolylsulfonyl)-N'-phenylurea, the ratio between the 4,4'-cyclohexylidenediphenol and the N-(p-tolylsulfonyl)-N'-phenylurea is preferably in a range of approximately 80:20 to 40:60, more preferably 75:25 to 55:45. In other words, the content of N-(p-tolylsulfonyl)-N'-phenylurea is preferably in a range of approximately 25 to 150 mass %, more preferably 33 to 82 mass %, relative to the 4,4'-cyclohexylidenediphenol.

There are no particular limitations on the proportion used of the color developer in the heat-sensitive recording layer, but this proportion is preferably in a range of approximately 10 to 60 mass %, particularly preferably approximately 20 to 50 mass %, relative to the total solid content of the heat-sensitive recording layer.

If the proportion used of the color developer is at least 10 mass %, then there is little risk of the recording sensitivity decreasing. Moreover, if this proportion is not more than 60 mass %, then there is little risk of the maximum recording density decreasing due to a decrease in the proportion of the leuco dye.

I-2. Leuco Dye

In the heat-sensitive recording layer, the leuco dye is used in the form of composite particles comprising the leuco dye and a hydrophobic resin.

There are no particular limitations on the type of the hydrophobic resin for forming the composite particles, but examples include urea-based resins, urethane-based resins, urea-urethane-based resins, styrene-based resins, and acrylic-based resins. Of these, urea-based resins and urea-urethane-based resins perform excellent heat resistance, in particular thermal background fogging resistance, and are thus preferable.

The form of the composite particles comprising the leuco dye and the hydrophobic resin in the present invention may be, for example:

(1) a form of microcapsulated particles in which at least one leuco dye and a hydrophobic organic solvent are encapsulated in a wall-film of the hydrophobic resin;

(2) a form in which the hydrophobic resin is polymerized on the surface of at least one type of leuco dye particles; or (3) a form in which at least one leuco dye is dispersed in solid hydrophobic resin particles.

The microcapsulated particles of (1) above in which the leuco dye and a hydrophobic organic solvent are encapsulated in a wall-film of the hydrophobic resin can be obtained by emulsifying the leuco dye and the organic solvent together, and then forming walls made of the hydrophobic resin around the oil droplets. For example, in the case of using a urea-urethane-based resin as the wall material, a polyvalent isocyanate compound and a second substance (for example a polyol compound or a polyamine compound) that will react with the polyvalent isocyanate compound to form the capsule walls are mixed together in an oily liquid in which the leuco dye and the organic solvent have been dissolved, the mixture is emulsified and dispersed in water, and then the temperature is increased, whereby a polymer forming reaction occurs at the oil droplet interfaces, so that the capsule walls are formed, whereby the composite particles are obtained.

The composite particles of the form of (2) above in which the hydrophobic resin is polymerized on the surface of leuco dye particles can be prepared, for example, as follows. A compound having an unsaturated carbon bond therein is added to a dispersion of particles comprising the leuco dye, and a polymerization initiator is added, and then heating is carried out as required, whereby the compound having the unsaturated carbon bond therein undergoes addition polymerization, so as to cover the surface of the leuco dye particles, whereby the composite particles can be obtained.

The form of the composite particles of (3) above in which a leuco dye is dispersed in the hydrophobic resin includes a form in which at least one leuco dye is dispersed in solid hydrophobic resin particles. In the case that the resin is a urea-based resin or a urethane-urea-based resin, the composite particles can be prepared, for example, as follows.

The leuco dye, and a compound that will form a polyurea or a polyurea-polyurethane through reaction with water are dissolved so as to prepare a solution. This solution is emulsified and dispersed in an aqueous medium containing dissolved therein a protective colloidal substance such as polyvinyl alcohol, a surfactant being added as required. The emulsified dispersion may further have a reactive substance such as a water-soluble polyamine added thereto if required. The emulsified dispersion is heated, so that the polymerizable component is polymerized, whereby composite particles comprising the leuco dye and a urea-based resin or urea-urethane-based resin are obtained. Here, the compound that will form the polyurea or polyurea-polyurethane through reaction with water may be a polyvalent isocyanate compound only, or may comprise a mixture of a polyvalent isocyanate compound and a polyol or polyamine that will react with the polyvalent isocyanate compound. Moreover, there may also be used an adduct between a polyvalent isocyanate compound and a polyol, or a polyvalent isocyanate compound multimer, for example a biuret or an isocyanurate.

Specific examples of the leuco dye include 3-[2,2-bis(1-ethyl-2-methylindol-3-yl)vinyl]-3-(4-diethyl aminophenyl) phthalide, 3,3-bis(p-dimethylaminophenyl)-6-dimethylaminophthalide, 3-(4-diethylamino-2-methylphenyl)-3-(4-dimethylaminophenyl)-6-dimethylaminophthalide, 3-cyclohexylamino-6-chlorofluoran, 3-diethylamino-6-methyl-7-chlorofluoran, 3-diethylamino-6,8-dimethylfluoran, 3-diethylamino-6,7-dimethylfluoran, 3-diethylamino-7-chlorofluoran, 3-(N-ethyl-N-isoamyl)amino-6-methyl-7-anilinofluoran, 3-di(n-butyl)amino-6-methyl-7-anilinofluoran, 3-di(n-pentyl)amino-6-methyl-7-anilinofluoran, 3-(N-ethyl-p-toluidino)-6-methyl-7-anilinofluoran, 3-di(n-butyl) amino-6-chloro-7-anilinofluoran, 3-diethylamino-6-methyl-7-(3-toluidino)fluoran, 3-pyrrolidino-6-methyl-7-anilinofluoran, 3-piperidino-6-methyl-7-anilinofluoran, 3,3-bis(4-diethylamino-2-ethoxyphenyl)-4-azaphthalide, 3,3-bis[1-(4-methoxyphenyl)-1-(4-dimethylaminophenyl)ethylen-2-yl]-4,5,6,7-tetrachlorophthalide, 3-p-(p-dimethylaminoanilino)anilino-6-methyl-7-chlorofluoran, 3-p-(p-chloroanilino)anilino-6-methyl-7-chlorofluoran, 3-[1,1-bis(1-ethyl-2-methylindol-3-yl)]-3-p-diethylaminophenylphthalide, 3,3-bis(1-n-butyl-2-methylindol-3-yl) phthalide, and 3,6-bis(dimethylamino)fluorene-9-spiro-3'-(6'-dimethylamino)phthalide. One of these may be used, or a plurality may be used.

Examples of polyvalent isocyanate compounds include p-phenylenediisocyanate, 2,6-tolylenediisocyanate, 2,4-tolylenediisocyanate, naphthalene-1,4-diisocyanate, dicyclohexylmethane-4,4'-diisocyanate, 1,3-bis(isocyanatomethyl) cyclohexane, 3,3'-dimethyldiphenylmethane-4,4'-diisocyanate, xylylene-1,4-diisocyanate, tetramethylxylylenediisocyanate, 4,4'-diphenylpropanediisocyanate, hexamethylenediisocyanate, butylene-1,2-diisocyanate, cyclohexylene-1,2-diisocyanate, cyclohexylene-1,4-diisocyanate, 4,4',4"-triphenylmethanetriisocyanate, toluene-2,4,6-triisocyanate, a trimethylolpropane adduct of hexamethylenediisocyanate, a trimethylolpropane adduct of 2,4-tolylenediisocyanate, and a trimethylolpropane adduct of xylylenediisocyanate. One of these may be used, or a plurality may be used.

Examples of polyol compounds include ethylene glycol, 1,3-propanediol, 1,4-butanediol, 1,7-heptanediol, 1,8-octanediol, propylene glycol, 1,3-dihydroxybutane, 2,2-dimethyl-1,3-propanediol, 2,5-hexanediol, 3-methyl-1,5-pentanediol, 1,4-cyclohexanedimethanol, dihydroxycyclohexane, diethylene glycol, phenylethylene glycol, pentaerythritol, 1,4-di(2-hydroxyethoxy)benzene, 1,3-di(2-hydroxyethoxy)benzene, p-xylyleneglycol, m-xylyleneglycol, 4,4'-isopropylidenediphenol, and 4,4'-dihydroxydiphenylsulfone. One of these may be used, or a plurality may be used.

Examples of polyamine compounds include ethylenediamine, trimethylenediamine, tetramethylenediamine, pentamethylenediamine, hexamethylenediamine, p-phenylenediamine, m-phenylenediamine, 2,5-dimethylpiperazine, triethylenetriamine, triethylenetetramine, and diethylaminopropylamine. One of these may be used, or a plurality may be used.

The above specific examples of leuco dyes, polyvalent isocyanate compounds, polyol compounds and polyamine compounds are ultimately only examples, there being no limitation to these compounds.

The content of the leuco dye in the composite particles is in a range of approximately 10 to 70 mass %, preferably approximately 35 to 60 mass %, relative to the total solid content of the composite particles.

The volume average particle diameter of the composite particles is preferably in a range of approximately 0.5 to 3.0 μm, particularly preferably 0.5 to 1.0 μm.

The composite particles may also contain any of sensitizers for improving the recording sensitivity, ultraviolet absorbers for improving the light-fastness, and stabilizers.

Sensitizers include, for example, aromatic organic compounds having a melting point in a range of approximately 40 to 150° C.

Stabilizers include, for example, hindered phenols, and hindered amines.

Ultraviolet absorbers include, for example, benzotriazole compounds, and benzophenone compounds.

The content of the composite particles in the heat-sensitive recording layer is in a range of approximately 10 to 60 mass %, preferably approximately 20 to 50 mass %, relative to the total solid content of the heat-sensitive recording layer.

Moreover, the ratio between the composite particles and the color developer in the heat-sensitive recording layer is an amount of the color developer in a range of approximately 50 to 300 parts by mass, preferably approximately 100 to 200 parts by mass, per 100 parts by mass of the composite particles.

If the leuco dye is in the form of composite particles comprising the leuco dye and a hydrophobic resin, then background fogging due to heat or humidity is reduced, and fading of a colored image is educed.

Moreover, for a solution of the leuco dye in an isocyanate compound or an organic solvent, the transparency of the heat-sensitive recording layer is better than in the case of using the leuco dye in the form of solid fine particles.

I-3. Formation of Heat-Sensitive Recording Layer

The heat-sensitive recording layer can generally be formed by preparing a heat-sensitive recording layer coating liquid by taking water as a medium, and mixing and stirring in the composite particles, the specified color developer, an adhesive, and auxiliary agents which are added as required, applying the prepared heat-sensitive recording layer coating liquid onto the support such that the applied amount will be approximately 3 to 25 g/m$^2$ after drying, and then drying.

Examples of the adhesive contained in the heat-sensitive recording layer coating liquid include polyvinyl alcohol compounds such as partially saponified or completely saponified polyvinyl alcohol, carboxy-modified polyvinyl alcohol, acetoacetyl-modified polyvinyl alcohol, diacetone-modified polyvinyl alcohol and silicon-modified polyvinyl alcohol, starch and derivatives thereof, cellulose derivatives such as hydroxymethylcellulose, hydroxyethylcellulose, hydroxypropylcellulose, methylcellulose and ethylcellulose, polyvinyl pyrrolidone, acrylamide-acrylic acid ester copolymers, acrylamide-acrylic acid ester-methacrylic acid ester copolymers, styrene-maleic anhydride copolymers, isobutylene-maleic anhydride copolymers, casein, gelatin and like water-soluble adhesives, and vinyl acetate-based latexes, urethane-based latexes, acrylic-based latexes, and styrene-butadiene-based latexes.

The content of the adhesive is preferably in a range of 10 to 50 mass %, particularly preferably approximately 15 to 40 mass %, relative to the total solid content of the heat-sensitive recording layer.

Examples of auxiliary agents include surfactants, waxes, lubricants, pigments, water resisting agents, antifoaming agents, fluorescent dyes, and colored dyes.

Surfactants include, for example, sodium dioctylsulfosuccinate, sodium dodecylbenzenesulfonate, and sodium lauryl alcohol sulfate.

Waxes include polyethylene wax, carnauba wax, paraffin wax, ester wax, and the like.

Lubricants include higher fatty acid metal salts such as zinc stearate, calcium stearate, and the like.

Pigments include, for example, kaolin, clay, talc, calcium carbonate, calcined kaolin, titanium oxide, amorphous silica, and aluminum hydroxide.

Water resisting agents include, for example, glyoxal, formalin, glycine, glycidyl esters, glycidyl ethers, dimethylolurea, ketene dimer, dialdehyde starch, melamine resins, polyamide resins, polyamide-epichlorohydrin resins, ketone-aldehyde resins, borax, boric acid, zirconium ammonium carbonate, and epoxy compounds.

Moreover, the heat-sensitive recording layer may further contain a storability improving agent so long as this is within a range such as not to impair the desired effects of the present invention.

Such storability improving agents include, for example, 1,1,3-tris(2-methyl-4-hydroxy-5-cyclohexylphenyl)butane, 1,1,3-tris(2-methyl-4-hydroxy-5-tert-butylphenyl)butane, 1,1-bis(4-hydroxyphenyl)-1-phenylethane, 2,2'-ethylidenebis(4,6-di-tert-butylphenol), 1,4-bis[α-methyl-α-(4'-hydroxyphenyl)ethyl]benzene, 1,3-bis[α-methyl-α-(4'-hydroxyphenyl)ethyl]benzene, 4,4'-thiobis(2-methyl-6-tert-butylphenol), and 1,3,5-tris(4-tert-butyl-3-hydroxy-2,6-dimethylbenzyl)isocyanuric acid.

In the case of including such a storability improving agent, the proportion used thereof is in a range of approximately 10 to 40 mass %, preferably approximately 15 to 30 mass %, relative to the total amount of the color developer.

Moreover, as required, the heat-sensitive recording layer may further contain any of a hindered phenol, a hindered amine or the like as a stabilizer, an ultraviolet absorber for improving the light-fastness, and a sensitizer able to be contained in the composite particles.

The heat-sensitive recording layer may have a multi-layer coloring layer structure in which a plurality of leuco dyes are disposed in different layers to one another, or a single-layer coloring layer structure in which a plurality of leuco dyes are contained in the same layer.

In the case of a heat-sensitive recording material having a transparent support, from the viewpoint of haze, a single-layer coloring layer structure in which a plurality of leuco dyes are contained in the same layer is preferably used.

There are no particular limitations on the method of forming the heat-sensitive recording layer, which may be formed using a suitable known application method. Examples of such known application methods include air knife coating, vari-bar blade coating, pure blade coating, rod blade coating, short-dwell coating, curtain coating, die coating, and gravure coating.

II. Support

There are no particular limitations on the support used in the heat-sensitive recording material of the present invention; for example, woodfree paper, laminated paper, synthetic paper, or a film substrate of polyethylene terephthalate, polypropylene, polyethylene or the like can be used. A film substrate may be transparent, or may be a colored transparent film.

The thickness of the support is in a range of approximately 20 to 200 μm, preferably approximately 75 to 200 μm.

It is preferable for the support to be a transparent film, since in this case, the effects of the present invention, i.e. suppressing fluctuation in the recording sensitivity due to change in environmental humidity and obtaining excellent image quality are exhibited satisfactorily.

To improve adhesion with the heat-sensitive recording layer, the surface of the support may have an anchor coat layer provided thereon, or may be subjected to corona discharge treatment. Furthermore, the surface of the support may be subjected to conductivity treatment with a conductive agent.

III. Heat-Sensitive Recording Material

The heat-sensitive recording material of the present invention can be manufactured by applying the heat-sensitive recording layer coating liquid onto at least one surface of the support, and drying so as to form the heat-sensitive recording layer.

Furthermore, if necessary, an undercoat layer may be provided between the support and the heat-sensitive recording layer.

Such an undercoat layer is formed by applying an undercoat layer coating liquid containing a pigment and an adhesive onto the support and drying. As the pigment, any of various ones can be used, examples generally being an inorganic pigment such as calcined clay, or an organic pigment such as a hollow or dense plastic pigment. Moreover, as the adhesive, an adhesive as used in the heat-sensitive recording layer described above can be used.

In the case of providing such an undercoat layer, the amount applied on is in a range of approximately 1 to 30 g/m$^2$, preferably approximately 5 to 20 g/m$^2$, in terms of the mass after drying.

Moreover, in the heat-sensitive recording material of the present invention, a protective layer may be provided on the heat-sensitive recording layer.

Such a protective layer can be obtained in general by obtaining a protective layer coating liquid by taking water as a medium, and mixing and stirring in an adhesive and any of various auxiliary agents or pigments which are added as required, and then applying the protective layer coating liquid obtained onto the heat-sensitive recording layer, and drying.

An example of the adhesive is one as used in the heat-sensitive recording layer described above. Examples are polyvinyl alcohol compounds such as partially saponified or completely saponified polyvinyl alcohol, carboxy-modified polyvinyl alcohol, acetoacetyl-modified polyvinyl alcohol, diacetone-modified polyvinyl alcohol and silicon-modified polyvinyl alcohol, starch and derivatives thereof, cellulose derivatives such as hydroxymethylcellulose, hydroxyethylcellulose, hydroxypropylcellulose, methylcellulose and ethylcellulose, polyvinyl pyrrolidone, acrylamide-acrylic acid ester copolymers, acrylamide-acrylic acid ester-methacrylic acid ester copolymers, styrene-maleic anhydride copolymers, isobutylene-maleic anhydride copolymers, casein, gelatin and like water-soluble adhesives, and vinyl acetate-based latexes, urethane-based latexes, acrylic-based latexes, and styrene-butadiene-based latexes.

There are no particular limitations on the amount of the adhesive, but this is preferably in a range of approximately 30 to 90 mass %, particularly preferably approximately 40 to 80 mass %, relative to the total solid content of the protective layer.

Examples of pigments include kaolin, clay, talc, calcium carbonate, calcined kaolin, titanium oxide, amorphous silica, and aluminum hydroxide, the particle diameter preferably being a volume average particle diameter of not more than 1 μm.

In the case of including a pigment, there are no particular limitations on the content thereof, but this content is preferably in a range of approximately 10 to 60 mass %, more preferably 15 to 50 mass %, relative to the total solid content of the protective layer.

Examples of auxiliary agents include surfactants, waxes, lubricants, water resisting agents, antifoaming agents, fluorescent dyes, and colored dyes.

Surfactants include, for example, sodium dioctylsulfosuccinate, sodium dodecylbenzenesulfonate, sodium lauryl alcohol sulfate, and perfluoroalkylethylene oxide adducts.

Waxes include, for example, polyethylene wax, carnauba wax and like paraffin wax and ester waxes such as potassium stearyl phosphate.

Lubricants include higher fatty acid amides such as stearic acid amide and ethylenebis-stearic acid amide, and higher fatty acid metal salts such as zinc stearate, calcium stearate, and the like.

Water resisting agents include glyoxal, formalin, glycine, glycidyl esters, glycidyl ethers, dimethylolurea, ketene dimer, dialdehyde starch, melamine resins, polyamide resins, polyamide-epichlorohydrin resins, ketone-aldehyde resins, adipic acid dihydrazide, borax, boric acid, zirconium ammonium carbonate, epoxy compounds, and the like.

In the case that such an auxiliary agent is contained, the amount used thereof may be set as appropriate from within a broad range.

Moreover, there are no particular limitations on the method of applying on the protective layer coating liquid, it being possible to use known means as appropriate. For example, air knife coating, vari-bar blade coating, pure blade coating, rod blade coating, short-dwell coating, curtain coating, die coating, gravure coating or the like can be used.

The amount applied of the protective layer coating liquid is in a range of approximately 0.5 to 10 g/m$^2$, preferably 2 to 5 g/m$^2$, in terms of dry mass.

Furthermore, the heat-sensitive recording material of the present invention may also be subjected to smoothing treatment using a supercalender or the like after any of the layers has been formed or after all of the layers have been formed.

Moreover, for the heat-sensitive recording material of the present invention, any of other various art that is known in the field of heat-sensitive recording material manufacture may be additionally used as required.

For the heat-sensitive recording material of the present invention obtained as described above, there is little fluctuation in recording sensitivity due to change in environmental humidity, and moreover thermal background fogging resistance and image quality are excellent.

Effect of the Invention

The heat-sensitive recording material of the present invention comprises a support and a heat-sensitive recording layer, wherein the heat-sensitive recording layer contains a leuco dye and a color developer, the leuco dye is in the form of composite particles comprising the leuco dye and a hydrophobic resin, and the color developer comprises 4,4'-cyclohexylidenediphenol and 4,4'-bis(N-p-tolylsulfonylaminocarbonylamino)diphenylmethane, whereby there is little fluctuation in recording sensitivity due to change in environmental humidity, and moreover image quality and thermal background fogging resistance are excellent.

In particular, in the case that the color developer is obtained through wet pulverizing of a composition comprising 4,4'-cyclohexylidenediphenol and 4,4'-bis(N-p-tolylsulfonylaminocarbonylamino)diphenylmethane, the image quality is further improved.

Moreover, in the case that the color developer further contains 4-hydroxy-4'-allyloxydiphenylsulfone, a blooming phenomenon of the heat-sensitive recording material can be prevented.

Moreover, in the case that the color developer further contains N-(p-tolylsulfonyl)-N'-phenylurea, fine image gradation can be obtained in the half tone region in particular.

The heat-sensitive recording material of the present invention having these characteristic features can be suitably used for medical application, in particular as a transparent heat-sensitive recording material for diagnostic imaging or the like.

BRIEF DESCRIPTION OF THE DRAWING

FIG. 1 is a graph showing the relationship between applied energy and recording density for heat-sensitive recording materials obtained in example 5 and example 7.

BEST MODE FOR CARRYING OUT THE INVENTION

The present invention will now be described in more detail through examples, although the present invention is not limited thereto.

Note that unless otherwise stated, "parts" and "%" mean "parts by mass" and "mass %" respectively. Moreover, the volume average particle diameter is the value measured using a laser diffraction particle size analyzer SALD 2000 (made by Shimadzu Corporation).

Example 1

Preparation of Liquid A

Composite Particle Dispersion

A leuco dye and an ultraviolet absorber were dissolved by heating to 150° C. in a solvent comprising polyvalent isocyanate compounds, thus preparing a solution.

Used as the leuco dye were 11 parts of 3-diethylamino-6-methyl-7-(3-toluidino)fluoran, 6 parts of 3-diethylamino-6,8-dimethylfluoran, and 5 parts of 3,3-bis(4-diethylamino-2-ethoxyphenyl)-4-azaphthalide.

10 parts of 2-hydroxy-4-octyloxybenzophenone was used as the ultraviolet absorber. 2 parts of dicyclohexylmethane-4,4'-diisocyanate (Desmodule W, made by Sumitomo Bayer Urethane Co., Ltd.) and 12 parts of m-tetramethylxylylenediisocyanate (TMXDI, made by Mitsui Takeda Chemicals, Inc.) were used as the polyvalent isocyanate compounds.

The solution was gradually added to 100 parts of an aqueous solution containing 8.5 parts of polyvinyl alcohol (Poval PVA-217EE, made by Kuraray Co., Ltd.) and 1.5 parts of an ethylene oxide adduct of acetylene glycol (Olfine E1010, made by Nissin Chemical Industry Co., Ltd.) as a surfactant, and emulsification and dispersion were carried out by stirring at 10,000 rpm using a homogenizer.

An aqueous solution comprising 2.5 parts of a polyvalent amine compound (Epicure T, made by Shell International Petroleum Co.) dissolved in 22.5 parts of water, and 30 parts of water were added to the resulting emulsified dispersion, and the dispersion was homogenized.

The emulsified dispersion obtained was heated to 75° C., and polymerization was carried out for 7 hours, whereby a leuco dye-containing composite particle dispersion having a volume average particle diameter of 0.8 μm was obtained. The liquid obtained was diluted with water, thus obtaining a dispersion containing 25% of the leuco dye-containing composite particles.

Preparation of Liquid B

Color Developer Dispersion

A composition comprising 42 parts of 4,4'-cyclohexylidenediphenol, 60 parts of a sulfone-modified polyvinyl alcohol 10% aqueous solution, and 18 parts of water was pulverized to a volume average particle diameter of 0.28 μm using an Ultravisco mill, thus obtaining a color developer dispersion.

Preparation of Liquid C

Color Developer Dispersion

A composition comprising 42 parts of 4,4'-bis(N-p-tolylsulfonylaminocarbonylamino)diphenylmethane, 60 parts of a sulfone-modified polyvinyl alcohol 10% aqueous solution, and 18 parts of water was pulverized to a volume average particle diameter of 0.30 μm using an Ultravisco mill, thus obtaining a color developer dispersion.

(Preparation of Heat-Sensitive Recording Layer Coating Liquid)

A composition comprising 100 parts of liquid A, 100 parts of liquid B, 20 parts of liquid C, 60 parts of a styrene-butadiene-based latex having a solid content of 48% (Smartex PA-9280, made by Nippon A&L Inc.), and 30 parts of water was mixed and stirred, thus obtaining a heat-sensitive recording layer coating liquid.

(Preparation of Protective Layer Coating Liquid)

A composition comprising 100 parts of an ionomeric urethane-based resin latex (Hydran (registered trademark) AP-30F, made by Dainippon Ink & Chemicals, Inc., solid content 20%), 500 parts of an acetoacetyl-modified polyvinyl alcohol (Gohsefimer (registered trademark) Z-410, made by Nippon Synthetic Chemical Industry Co., Ltd., polymerization degree: approximately 2300, saponification degree: approximately 98 mol %) 8% aqueous solution, 5 parts of a polyamideamine-epichlorohydrin 25% aqueous solution, 50 parts of a 60% slurry of kaolin (UW-90, made by Engelhard Corporation) of volume average particle diameter 0.8 μm, 26 parts of stearic acid amide (Hymicron L-271, made by Chukyo Yushi Co., Ltd., solid content 25%), 4 parts of potassium stearyl phosphate (Woopol 1800, made by Matsumoto Yushi-Seiyaku Co., Ltd., solid content 35%), 15 parts of a perfluoroalkylethylene oxide adduct (Surflon (registered trademark) S-145, made by Seimi Chemical Co., Ltd.) 10% aqueous solution, and 300 parts of water was mixed and stirred, thus obtaining a protective layer coating liquid.

(Manufacture of Heat-Sensitive Recording Material)

A heat-sensitive recording layer was provided on one surface of a blue transparent polyethylene terephthalate film (Melinex 912, thickness 175 μm, made by Teijin DuPont Films Japan Limited) by applying on the heat-sensitive recording layer coating liquid using a slot die coater and drying such that the amount applied after drying was 20 g/m$^2$. A protective layer was provided thereon by applying on the protective layer coating liquid using a slot die coater and drying such that the amount applied after drying was 3.5 g/m$^2$, whereby a heat-sensitive recording material was obtained.

Example 2

A heat-sensitive recording material was obtained as in example 1, except that in the preparation of the heat-sensitive recording layer coating liquid, 50 parts of liquid B and 50 parts of following liquid D were used instead of the 100 parts of liquid B.

Preparation of Liquid D

Color Developer Dispersion

A composition comprising 42 parts of N-(p-tolylsulfonyl)-N'-phenylurea, 60 parts of a sulfone-modified polyvinyl alcohol 10% aqueous solution, and 18 parts of water was pulverized to a volume average particle diameter of 0.30 μm using an Ultravisco mill, thus obtaining a color developer dispersion.

Example 3

A heat-sensitive recording material was obtained as in example 1, except that in the preparation of the heat-sensitive recording layer coating liquid, 45 parts of liquid B, 45 parts of liquid D, and 10 parts of following liquid E were used instead of the 100 parts of liquid B.

Preparation of Liquid E

Color Developer Dispersion

A composition comprising 42 parts of 4-hydroxy-4'-allyloxydiphenylsulfone, 60 parts of a sulfone-modified polyvinyl alcohol 10% aqueous solution, and 18 parts of water was pulverized to a volume average particle diameter of 0.30 μm using an Ultravisco mill, thus obtaining a color developer dispersion.

Example 4

A heat-sensitive recording material was obtained as in example 1, except that in the preparation of the heat-sensitive recording layer coating liquid, 120 parts of following liquid F was used instead of the 100 parts of liquid B and the 20 parts of liquid C.

Preparation of Liquid F

Mixed Color Developer Dispersion

A composition comprising 26 parts of 4,4'-cyclohexylidenediphenol, 16 parts of 4,4'-bis(N-p-tolylsulfonylaminocarbonylamino)diphenylmethane, 60 parts of a sulfone-modified polyvinyl alcohol 10% aqueous solution, and 18 parts of water was pulverized to a volume average particle diameter of 0.28 μm using an Ultravisco mill, thus obtaining a mixed color developer dispersion.

Example 5

A heat-sensitive recording material was obtained as in example 1, except that in the preparation of the heat-sensitive recording layer coating liquid, 100 parts of following liquid G and 20 parts of liquid D were used instead of the 100 parts of liquid B and the 20 parts of liquid C.

Preparation of Liquid G

Mixed Color Developer Dispersion

A composition comprising 23 parts of 4,4'-cyclohexylidenediphenol, 14 parts of 4,4'-bis(N-p-tolylsulfonylaminocarbonylamino)diphenylmethane, 5 parts of 4-hydroxy-4'-allyloxydiphenylsulfone, 60 parts of a sulfone-modified polyvinyl alcohol 10% aqueous solution, and 18 parts of water was pulverized to a volume average particle diameter of 0.28 μm using an Ultravisco mill, thus obtaining a mixed color developer dispersion.

Example 6

A heat-sensitive recording material was obtained as in example 1, except that in the preparation of the heat-sensitive recording layer coating liquid, 66 parts of liquid B, 29.5 parts of liquid C, and 24.5 parts of liquid E were used instead of the 100 parts of liquid B and the 20 parts of liquid C.

Example 7

A heat-sensitive recording material was obtained as in example 1, except that in the preparation of the heat-sensitive recording layer coating liquid, 120 parts of following liquid H was used instead of the 100 parts of liquid B and the 20 parts of liquid C.

Preparation of Liquid H

Mixed Color Developer Dispersion

A composition comprising 23 parts of 4,4'-cyclohexylidenediphenol, 10 parts of 4,4'-bis(N-p-tolylsulfonylaminocarbonylamino)diphenylmethane, 9 parts of 4-hydroxy-4'-allyloxydiphenylsulfone, 60 parts of a sulfone-modified polyvinyl alcohol 10% aqueous solution, and 18 parts of water was pulverized to a volume average particle diameter of 0.28 μm using an Ultravisco mill, thus obtaining a mixed color developer dispersion.

Comparative Example 1

A heat-sensitive recording material was obtained as in example 1, except that in the preparation of the heat-sensitive recording layer coating liquid, the 20 parts of liquid C was not used.

Comparative Example 2

A heat-sensitive recording material was obtained as in example 1, except that in the preparation of the heat-sensitive recording layer coating liquid, 50 parts of liquid B and 50 parts of liquid D were used instead of the 100 parts of liquid B, and the 20 parts of liquid C was not used.

Comparative Example 3

A heat-sensitive recording material was obtained as in example 1, except that in the preparation of the heat-sensitive recording layer coating liquid, 100 parts of following liquid I was used instead of the 100 parts of liquid B, and the 20 parts of liquid C was not used.

Preparation of Liquid I

Color Developer Dispersion

A composition comprising 42 parts of 3,3'-diallyl-4,4'-dihydroxydiphenylsulfone, 60 parts of a sulfone-modified polyvinyl alcohol 10% aqueous solution, and 18 parts of water was pulverized to a volume average particle diameter of 0.30 μm using an Ultravisco mill, thus obtaining a color developer dispersion.

Comparative Example 4

A heat-sensitive recording material was obtained as in example 1, except that in the preparation of the heat-sensitive recording layer coating liquid, 100 parts of following liquid J was used instead of the 100 parts of liquid B, and the 20 parts of liquid C was not used.

Preparation of Liquid J

Color Developer Dispersion

A composition comprising 42 parts of 4-hydroxy-4'-isopropoxydiphenylsulfone, 60 parts of a sulfone-modified polyvinyl alcohol 10% aqueous solution, and 18 parts of water was pulverized to a volume average particle diameter of 0.30 μm using an Ultravisco mill, thus obtaining a color developer dispersion.

Comparative Example 5

A heat-sensitive recording material was obtained as in example 1, except that in the preparation of the heat-sensitive recording layer coating liquid, 120 parts of following liquid K was used instead of the 100 parts of liquid B, and the 20 parts of liquid C was not used.

Preparation of Liquid K

Color Developer Dispersion

A composition comprising 42 parts of 4,4'-dihydroxydiphenylsulfone, 60 parts of a sulfone-modified polyvinyl alcohol 10% aqueous solution, and 18 parts of water was pulverized to a volume average particle diameter of 0.30 μm using an Ultravisco mill, thus obtaining a color developer dispersion.

Comparative Example 6

A heat-sensitive recording material was obtained as in example 1, except that in the preparation of the heat-sensitive recording layer coating liquid, 35 parts of following liquid L and 55 parts of water were used instead of the 100 parts of liquid A and the 30 parts of water.

Preparation of Liquid L

Leuco Dye Dispersion

A composition comprising 11 parts of 3-diethylamino-6-methyl-7-(3-toluidino)fluoran, 6 parts of 3-diethylamino-6,8-dimethylfluoran, 5 parts of 3,3-bis(4-diethylamino-2-ethoxyphenyl)-4-azaphthalide, 10 parts of 2-hydroxy-4-octyloxybenzophenone, 20 parts of a sulfone-modified polyvinyl alcohol 10% aqueous solution, and 46 parts of water was pulverized to a volume average particle diameter of 0.6 μm using an Ultravisco mill.

[Evaluation]

For the heat-sensitive recording material thus obtained, evaluation was carried out as follows.

(Recording Density)

The heat-sensitive recording materials obtained in each of the examples and comparative examples were left for 24 hours in a 23° C.×50% RH environment, and then recording was carried out in gradation mode using a thermal printer UP-DF500 (made by Sony Corporation). Next, the density at the recorded portions was measured in visual mode using a Macbeth densitometer (trade name: TR-927J, made by Macbeth Corp.). Of a total of 16 gradations (steps), the recorded densities for the $9^{th}$ and $16^{th}$ gradations (steps) are shown in Table 1. Moreover, for the heat-sensitive recording material obtained in examples 5 and 7, the recorded densities for all 16 of the gradations (steps) are shown on a graph in FIG. 1.

Similarly, each heat-sensitive recording material was left for 24 hours in a 23° C.×20% RH environment, and then recording was carried out in gradation mode using the thermal printer UP-DF500 (made by Sony Corporation). Next, the density at the recorded portions was measured in visual mode using the Macbeth densitometer. Of the total of 16 gradations (steps), the recording density for the $9^{th}$ gradation (step) is shown in Table 1.

(Fluctuation in Recording Sensitivity Due to Change in Environmental Humidity)

The percentage fluctuation was determined through following formula 1 from the recording density for the $9^{th}$ gradation (step) recorded under the 23° C.×50% RH environment and the recording density for the $9^{th}$ gradation (step) recorded under the 23° C.×20% RH environment as obtained through the above recording density measurement, and this was evaluated as the fluctuation in the recording sensitivity due to change in environmental humidity. The results are shown in Table 1.

$$\text{Percentage fluctuation}=[(A-B)/B]\times 100 \qquad \text{Formula 1}$$

(A represents the value of the recording density under the 23° C.×20% RH environment. B represents the value of the recording density under the 23° C.×50% RH environment.)

There is a problem in practice if the absolute value of the percentage fluctuation is 25% or more.

(Evaluation of Thermal Background Fogging Resistance)

Each heat-sensitive recording material was treated for 24 hours under a 60° C.×20% RH environment, and then a non-recorded portion was subjected to measurement in visual mode using a Macbeth densitometer (trade name: TR-927J, made by Macbeth Corp.).

(Evaluation of Image Quality)

The heat-sensitive recording layer coating liquid of each of examples 1 to 7 and comparative examples 1 to 6 was left for 3 days under a 23° C.×50% RH environment, and then a heat-sensitive recording material was manufactured. Each heat-sensitive recording material thus obtained was left for 24 hours in a 23° C.×50% RH environment, and then recording was carried out on 10 sheets (17×14 inch/sheet) in whole sheet half tone mode using a thermal printer UP-DF500 (made by Sony Corporation), the number of black lumps (number of defects) arising on the heat-sensitive recording material was measured visually, and the image quality was evaluated in accordance with the following. The results are shown in Table 1. There is a problem in practice if the number of defects is 5 or more.

(○): 0

○: 1 to 4

Δ: 5 to 10 x: 11 or more (Evaluation of Blooming Prevention)

Each heat-sensitive recording material was left for 24 hours in a 23° C.×50% RH environment, and then recording was carried out in gradation mode using a thermal printer UP-DF500 (made by Sony Corporation), the heat-sensitive recording material was treated for 24 hours under a 40° C.×90% RH environment, the extent of blooming in the recorded portions after the treatment was measured visually, and evaluation was carried out in accordance with the following. The results are shown in Table 1.

(○): No blooming seen at all.

○: Slight blooming seen.

x: Severe blooming, decrease in density seen at recorded portions, problem in practice.

TABLE 1

| | Recording Density | | | | | | |
|---|---|---|---|---|---|---|---|
| | 23° C. × 50% RH | | 23° C. × 20% RH | Percentage | Thermal Background | | |
| | $9^{th}$ Step | $16^{th}$ Step | $9^{th}$ Step | Fluctuation (%) | Fogging Resistance | Image Quality | Blooming Prevention |
| Ex. 1 | 1.29 | 2.61 | 1.06 | −17.8 | 0.21 | ○ | ○ |
| Ex. 2 | 1.15 | 3.40 | 0.92 | −20.0 | 0.21 | ○ | ○ |
| Ex. 3 | 1.16 | 3.38 | 0.93 | −19.8 | 0.22 | ○ | (○) |
| Ex. 4 | 1.21 | 2.54 | 1.00 | −17.4 | 0.21 | (○) | ○ |
| Ex. 5 | 1.04 | 3.28 | 0.84 | −19.2 | 0.22 | (○) | (○) |
| Ex. 6 | 1.32 | 3.14 | 1.18 | −10.6 | 0.21 | ○ | (○) |
| Ex. 7 | 1.33 | 3.16 | 1.19 | −10.5 | 0.21 | (○) | (○) |
| Comparative Ex. 1 | 1.34 | 2.65 | 1.12 | −16.4 | 0.23 | x | x |
| Comparative Ex. 2 | 1.21 | 3.31 | 0.95 | −21.5 | 0.22 | Δ | ○ |
| Comparative Ex. 3 | 1.35 | 3.45 | 0.71 | −47.4 | 0.23 | ○ | (○) |
| Comparative Ex. 4 | 1.09 | 2.88 | 0.62 | −43.1 | 0.22 | ○ | (○) |

TABLE 1-continued

| | Recording Density | | | | | | |
|---|---|---|---|---|---|---|---|
| | 23° C. × 50% RH | | 23° C. × 20% RH | Percentage | Thermal Background | | |
| | 9th Step | 16th Step | 9th Step | Fluctuation (%) | Fogging Resistance | Image Quality | Blooming Prevention |
| Comparative Ex. 5 | 0.89 | 3.21 | 0.32 | −64.0 | 0.22 | ○ | (○) |
| Comparative Ex. 6 | 1.53 | 3.59 | 1.16 | −24.2 | 0.36 | ○ | ○ |

As can be seen from Table 1, for the heat-sensitive recording materials of the examples of the present application, the percentage fluctuation was not more than 20%, showing that there is little change in the recording density due to change in environmental humidity. Moreover, for the thermal background fogging resistance, a value of not more than 0.3 was obtained, and hence it can be seen that the thermal background fogging resistance was also excellent. Furthermore, for the image quality, an evaluation of "○" or better was obtained, and hence excellent image quality was also exhibited.

In particular, for the heat-sensitive recording material for which the color developer was obtained through wet pulverizing of 4,4'-cyclohexylidenediphenol and 4,4'-bis(N-p-tolylsulfonylaminocarbonylamino)diphenylmethane (examples 4, 5 and 7), the evaluation of the image quality was "(○)" or better, and hence it can be seen that the image quality was even more excellent.

Furthermore, for the heat-sensitive recording material in which the color developer further contained 4-hydroxy-4'-allyloxydiphenylsulfone (examples 3, and 5 to 7), an evaluation of "(○)" or better was obtained for the blooming prevention, and hence it can be seen that the blooming prevention was even more excellent.

Moreover, as shown in FIG. 1, for the heat-sensitive recording material further containing N-(p-tolylsulfonyl)-N'-phenylurea (example 5), compared with the heat-sensitive recording material not containing N-(p-tolylsulfonyl)-N'-phenylurea (example 7), it can be seen that change in the recording density with applied energy was suppressed in a halftone region, the change in the recording density being gradual. As a result, it can be seen that by also using N-(p-tolylsulfonyl)-N'-phenylurea, fine gradation can be realized in the halftone region in particular.

INDUSTRIAL APPLICABILITY

For the heat-sensitive recording material of the present invention, there is little fluctuation in recording sensitivity due to change in environmental humidity, and moreover image quality and thermal background fogging resistance are excellent.

The heat-sensitive recording material of the present invention having these characteristic features can be suitably used in any of various applications for which it is required that the recording density be always constant.

In particular, the heat-sensitive recording material of the present invention can be suitably used as a heat-sensitive recording material used in medical treatment for which it is strongly demanded that recording be possible with multiple gradient steps, and that the recording density be always constant, not being affected by changes in the humidity of the environment, in particular as a heat-sensitive recording material used in diagnostic imaging such as MRI diagnostic imaging or X-ray diagnostic imaging or the like.

The invention claimed is:

1. A heat-sensitive recording material comprising a support and a heat-sensitive recording layer, wherein:

the heat-sensitive recording layer contains a leuco dye and a color developer;

the leuco dye is in a form of composite particles comprising the leuco dye and a hydrophobic resin; and the color developer comprises 4,4'-cyclohexylidenediphenol and 4,4'-bis(N-p-tolylsulfonylaminocarbonylamino)diphenylmethane.

2. A heat-sensitive recording material according to claim 1, wherein the color developer is obtained through wet pulverizing of a composition comprising 4,4'-cyclohexylidenediphenol and 4,4'-bis(N-p-tolylsulfonylaminocarbonylamino)diphenylmethane.

3. A heat-sensitive recording material according to claim 1, wherein the content of 4,4'-bis(N-p-tolylsulfonylaminocarbonylamino)diphenylmethane is in a range of 15 to 75 mass % relative to 4,4'-cyclohexylidenediphenol.

4. A heat-sensitive recording material according to claim 1, wherein the color developer further contains 4-hydroxy-4'-allyloxydiphenylsulfone.

5. A heat-sensitive recording material according to claim 4, wherein the color developer is obtained through wet pulverizing of a composition comprising 4,4'-cyclohexylidenediphenol, 4,4'-bis(N-p-tolylsulfonylaminocarbonylamino)diphenylmethane, and 4-hydroxy-4'-allyloxydiphenylsulfone.

6. A heat-sensitive recording material according to claim 4, wherein the content of 4-hydroxy-4'-allyloxydiphenylsulfone is in a range of 10 to 50 mass % relative to 4,4'-cyclohexylidenediphenol.

7. A heat-sensitive recording material according to claim 1, wherein the color developer further contains N-(p-tolylsulfonyl)-N'-phenylurea.

8. A heat-sensitive recording material according to claim 7, wherein the content of N-(p-tolylsulfonyl)-N'-phenylurea is in a range of 25 to 150 mass % relative to 4,4'-cyclohexylidenediphenol.

9. A heat-sensitive recording material according to claim 1, wherein the hydrophobic resin in the composite particles is a urea-based resin or a urea-urethane-based resin.

10. A heat-sensitive recording material according to claim 1, wherein the support is a transparent film.

11. A heat-sensitive recording material according to claim 1, further comprising a protective layer.

12. A heat-sensitive recording material according to claim 1, wherein the color developer further contains 4-hydroxy-4'-allyloxydiphenylsulfone and N-(p-tolylsulfonyl)-N'-phenylurea.

* * * * *